US007162943B1

(12) United States Patent
Reitmeyer et al.

(10) Patent No.: US 7,162,943 B1
(45) Date of Patent: Jan. 16, 2007

(54) CAVITATING EXPLOSIVELY AUGMENTED WATER-JET MINE CUTTER SYSTEM

(75) Inventors: Gregory Reitmeyer, Panama City, FL (US); Robert Woodall, Panama City, FL (US); Felipe Garcia, Panama City, FL (US); Christopher Doyle, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 19 days.

(21) Appl. No.: 11/058,714

(22) Filed: Feb. 14, 2005

(51) Int. Cl.
*F42B 33/06* (2006.01)

(52) U.S. Cl. ..... 89/1.13; 86/50

(58) Field of Classification Search ..... 89/1.13; 86/50

See application file for complete search history.

(56) References Cited

U.S. PATENT DOCUMENTS 3,112,669 A * 12/1963 Damblanc ..... 89/1.13
3,371,611 A * 3/1968 Ogden et al. ..... 417/321
4,008,644 A * 2/1977 Kayser ..... 89/1.13
4,169,403 A * 10/1979 Hanson ..... 86/50
5,460,154 A * 10/1995 Mattern et al. ..... 124/56
6,298,763 B1 * 10/2001 Greenfield et al. ..... 89/1.13
6,408,731 B1 * 6/2002 Elsener ..... 86/50
6,681,675 B1 * 1/2004 Miller ..... 86/50
7,000,546 B1 * 2/2006 Bender et al. ..... 102/402
2002/0112598 A1 * 8/2002 Miller ..... 86/50
2006/0037462 A1 * 2/2006 Marcolla ..... 89/1.13

OTHER PUBLICATIONS

Sandia National Library, Water Jet System Could Deactivate Battlefield Land Mines, Jan. 1992, Sandia Science News, p. 555, (a more legible copy is provided as p. 2 of the document found on the internet at http://www.findarticles.com/p/articles/mi_m3820/is_n1_v27/ai_12041019/print).*

* cited by examiner

*Primary Examiner*—Michael J. Carone
*Assistant Examiner*—Bret Hayes
(74) *Attorney, Agent, or Firm*—James T. Shepherd

(57) ABSTRACT

A method and system for neutralizing mines has a vehicle carrying fluid connected to a pump and cavitation pressure vessel that creates high pressure fluid. An actuator valve modifies the flow characteristics of the high pressure fluid to be pulsating at selectively different frequencies, pressures, and flow rate. Nozzles on the vehicle jet high pressure fluid therethrough and a framework on the vehicle orients the nozzles to direct the jetted flow of high pressure fluid downward and into ground under a roadway. An abrasive and/or explosive can be added to the high pressure fluid before it reaches the nozzles. The jetted flow from the nozzles can displace ground and exert pressure to detonate and cut mines and neutralize them on and under the roadway. Cavitation can be created in the jetted flow to increase the dynamic force of the jetted flow.

9 Claims, 2 Drawing Sheets

CAVITATING EXPLOSIVELY AUGMENTED WATER-JET MINE CUTTER SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to systems for neutralizing ordnance. More particularly, this invention relates to a system that uses an array of downwardly aimed nozzles directing forceful, high pressure jets of fluid for clearing explosive obstacles including buried mines along an uninterrupted path and can survive mine-clearing operations.

Military and non-military agencies are still searching for a system that will effectively, reliably and safely de-mine roadway and off-roadway areas that are known or suspected to contain mechanical and electrical initiated mines. The basic requirement for an effective de-mining system is to detonate or disrupt either the mechanical or electrical firing train of each individual mine to effectively neutralize the mine.

Some military and non-military agencies already use a variety of means and apparatuses to clear areas of known/suspected mines on land and on roadways. Existing mine mitigation and neutralization systems have had some success, but current methods typically have major deficiencies that limit their intended capability. These limitations include high-cost, heavy weights, large sizes, difficulty of transportation, poor survivability from the explosions that these systems are intended to neutralize, logistical burdens, spare parts supply difficulties, etc. Currently none of these systems employ a concept of clearing mines with any type of water-jet technology.

Thus, in accordance with this inventive concept, a need has been recognized in the state of the art for a system for clearing surface and buried ordnance such as mines that uses an array of high-pressure fluid jets operating in several modes to destroy or disrupt the firing train of the ordnance without creating an undue risk of self-destruction.

OBJECTS AND SUMMARY OF THE INVENTION

An object of the invention is to provide a mine neutralization system using cavitating water-jets and/or explosively augmented water-jets.

Another object of the invention is to provide a portable mine neutralization system adapted to fit on a variety of vehicles and operate over a variety of surfaces and soils for the purpose of mine mitigation.

Another object of the invention is to provide a mine neutralization system capable of resisting destruction or damage by detonating mines during their neutralization.

Another object of the invention is to provide a mine neutralization system that effectively destroys mines or neutralizes tactically buried mines along a path on a road or off-road, regardless of the surface or soil condition.

Another object of the invention is to provide a mine neutralization system adapted to fit multiple vehicles for mitigating threat to vehicles and personnel from mines scattered on a roadway.

Another object of the invention is to provide a mine neutralization system mounted on a motor vehicle for high-speed sweeping of scattered mines over a full width area on or off a roadway.

Another object of the invention is to provide a mine neutralization system that eliminates the cumbersome, expensive, and labor intensive limitations otherwise associated with contemporary mine neutralization systems.

Another object of the invention is to provide a safer and more effective mine neutralization system having reduced maintenance and spare parts requirements.

Another object of the invention is to provide a mine neutralization system having a variable depth of penetration and being tune-able to soil/road/hard pack conditions.

These and other objects of the invention will become more readily apparent from the ensuing specification when taken in conjunction with the appended claims.

Accordingly, the present invention is to a system and method for neutralizing mines. A vehicle provides transportation of this system on a roadway, and may have a fluid source for clearing operations. A pump on the vehicle partially raises the pressure of the fluid and a cavitation pressure vessel on the vehicle is connected to the pump to generate or raise the pressure of the fluid to high pressure. An actuator valve is coupled to the vessel to selectively modify the flow characteristics of the high pressure fluid to be pulsating at selectively different frequencies, pressures, and flow rates including continuous flow. At least one of a plurality of nozzles supported by the vehicle is coupled to the actuator valve to jet the flow of high pressure fluid to the nozzles. A framework on the vehicle is connected to the nozzles to orient them in order to direct the jetted flow of high pressure fluid downward and into the ground under the roadway. An abrasive additive unit may be coupled to receive the high pressure fluid from the actuator valve to add abrasive to the high pressure fluid before it reaches the nozzles. An explosive additive unit may be coupled to receive the high pressure fluid from the actuator valve to add explosive to the high pressure fluid before it reaches the nozzles. The jetted flow of the high pressure fluid from the nozzle can displace ground, exert pressure to detonate the mines, and cut parts of the mines to neutralize them on and under the roadway. The pump and cavitation pressure vessel are capable of raising the pressure of the high pressure fluid to cause cavitation in the jetted flow of high pressure fluid and increase the capability of the jetted flow of high pressure fluid to displace the ground, exert pressure to detonate the mines, and cut parts of the mines.

DESCRIPTION OF THE PREFERRED EMBODIMENTS

Figure 1:
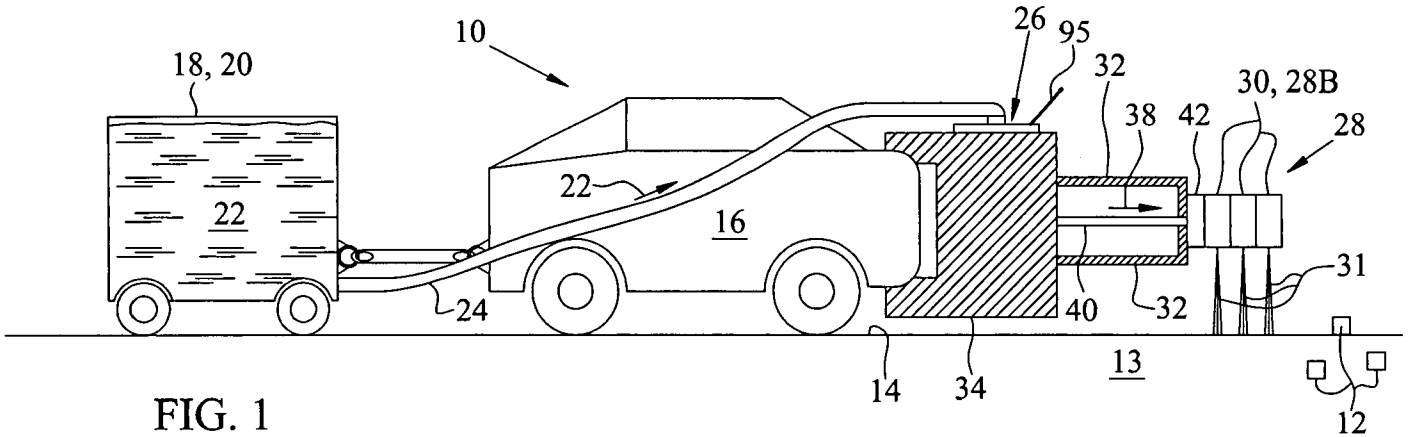
FIG. 1 is a schematic side view, partially in cross section, of the mine neutralization system of the invention for jetting fluid into the ground to neutralize mines while reducing unwanted casualties and damage to a support vehicle.
Figure 2:
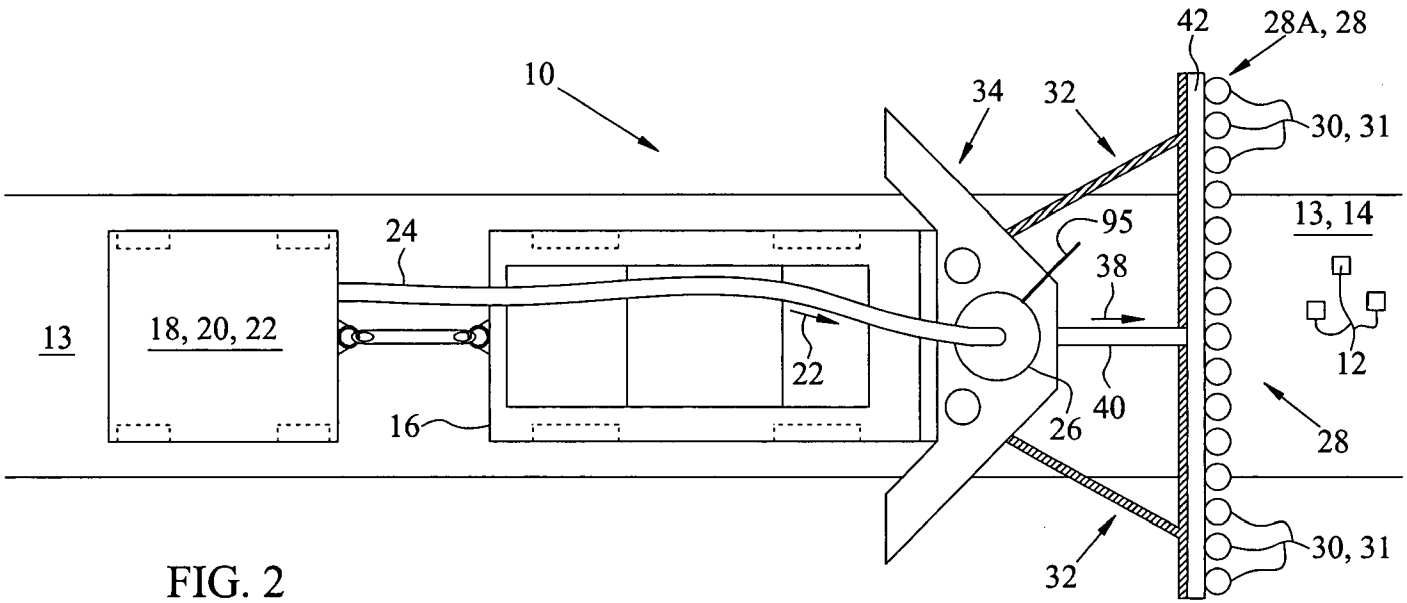
FIG. 2 is a schematic, top view of the mine neutralization system of the invention of FIG. 1 showing an exemplary arrangement of constituents thereof.

Referring to FIGS. 1 and 2, mine neutralization system 10 of the invention is a mobile highly effective means for clearing mines 12 buried in and on the ground 13 along and/or around a roadway 14 intended for safe passage of men and vehicles. A support vehicle 16 tows an interconnected trailer 18 having a tank 20 or other source of water 22 or any other readily available suitable fluid that is used as a water/fluid supply for clearing operations. A water feed line 24 extends forward from tank 20 to provide water 22 to a high water/fluid pressure generating module 26, see also FIG. 3.

Mine neutralization system 10 of the invention also allows combination of support vehicle 16, trailer 18, water-tank 20 with water 22, feed line 24, and high fluid pressure generating module 26 into a single heavy-duty truck or tracked vehicle or nearly any other means of locomotion at hand near the clearing site. These vehicles could be remotely controlled to further reduce the possibility of human casualties. Optionally, pressurized water 22 from a municipal water source can be coupled via an elongated feed line 24 to high fluid pressure generating module 26. This inherent flexibility permits rapid deployment and application of mine neutralization system 10 wherever mine clearing operations are to be performed.

An array 28 of high pressure nozzles 30 is mounted on a forwardly extending framework 32 connected to support vehicle 16. Framework 32 is connected to array 28 of nozzles 30 to direct or orient nozzles 30 to have water jets or jetted fluid 31 from nozzles 30 ejected in a downward direction toward roadway 14. In accordance with long proven nozzle designs such as those developed for and used by gold mining and other water-jet technologies, individual ones of nozzles 30 can be made to each produce a water or fluid-jet 31 having the desired shape and mass-flow properties to transmit sufficient dynamic hydraulic forces to jet-away enough of ground 13 to expose and/or detonate mines 12. Nozzles 30 can also be appropriately shaped to form jets 31 having sufficient concentrated force to slice through or cut-away parts of mines 12 and/or portions of their interconnected detonating trains to prevent them from detonating. In either case jets 31 from array 30 neutralize mines 12 buried in ground 13 under roadway 14 or lying on roadway 14 on ground 13.

Array 28 of nozzles 30 is depicted in FIG. 2 as being a single laterally aligned line array 28A of nozzles 30 that extends the desired length to reach across roadway 14 and beyond the sides of roadway 14. FIG. 1 shows array 28 of nozzles 30 as being several adjacent line arrays 28B of nozzles 30 that each extend the desired length to reach across roadway 14. Arrays 28B may have their nozzles 30 arranged in a laterally staggered fashion with respect to each other to assure more complete coverage across roadway 14 as support vehicle 16 travels forward on roadway 14. Other arrangements of line arrays and nozzles 30 of array 28 can be made and used within the scope of this inventive concept. Mine neutralization system 10 can have only a single nozzle 30 jetting a single fluid-jet 31 or multiple nozzles 30 each ejecting a jet 31 that may be mounted on different array support structures or framework 32 that can be laterally expandable and/or retractable and can be designed to be wider than the tow or push vehicle 16 for wider lane clearance.

An essentially outwardly flared blast-deflection shield 34 having a shape similar to a reinforced snowplow blade also is mounted forward on support vehicle 16. Framework 32 locates array 28 of nozzles 30 spaced-away in front of support vehicle 16 and above roadway 14 to direct jets 31 onto and into roadway 14, and the reinforced blade of blast-deflection shield 34 is interposed between array 28 of nozzles 30 and support vehicle 16 to protect equipment and personnel in vehicle 16 from the effects of blast and fragments when mines 12 are detonated under nozzles 30.

Array 28 of nozzles 30 is connected to receive a flow of highly-pressurized fluid/water, shown as arrow 38, from fluid pressure generating module 26 over at least one high-pressure feeder line 40. High pressure feeder line 40 can be connected to a manifold 42 to distribute highly pressurized water 38 to nozzles 30. Optionally, a separate high pressure feeder line 40 extending from fluid pressure generating module 26 could be included for each nozzle 30 if, for example, different flow rates of highly-pressurized water 38 were wanted at different ones of nozzles 30 or if some of nozzles 30 were to be shut off during clearing operations to try to protect a strip of roadway 14 having, for example, a water or sewer line buried in the strip.

Figure 3:
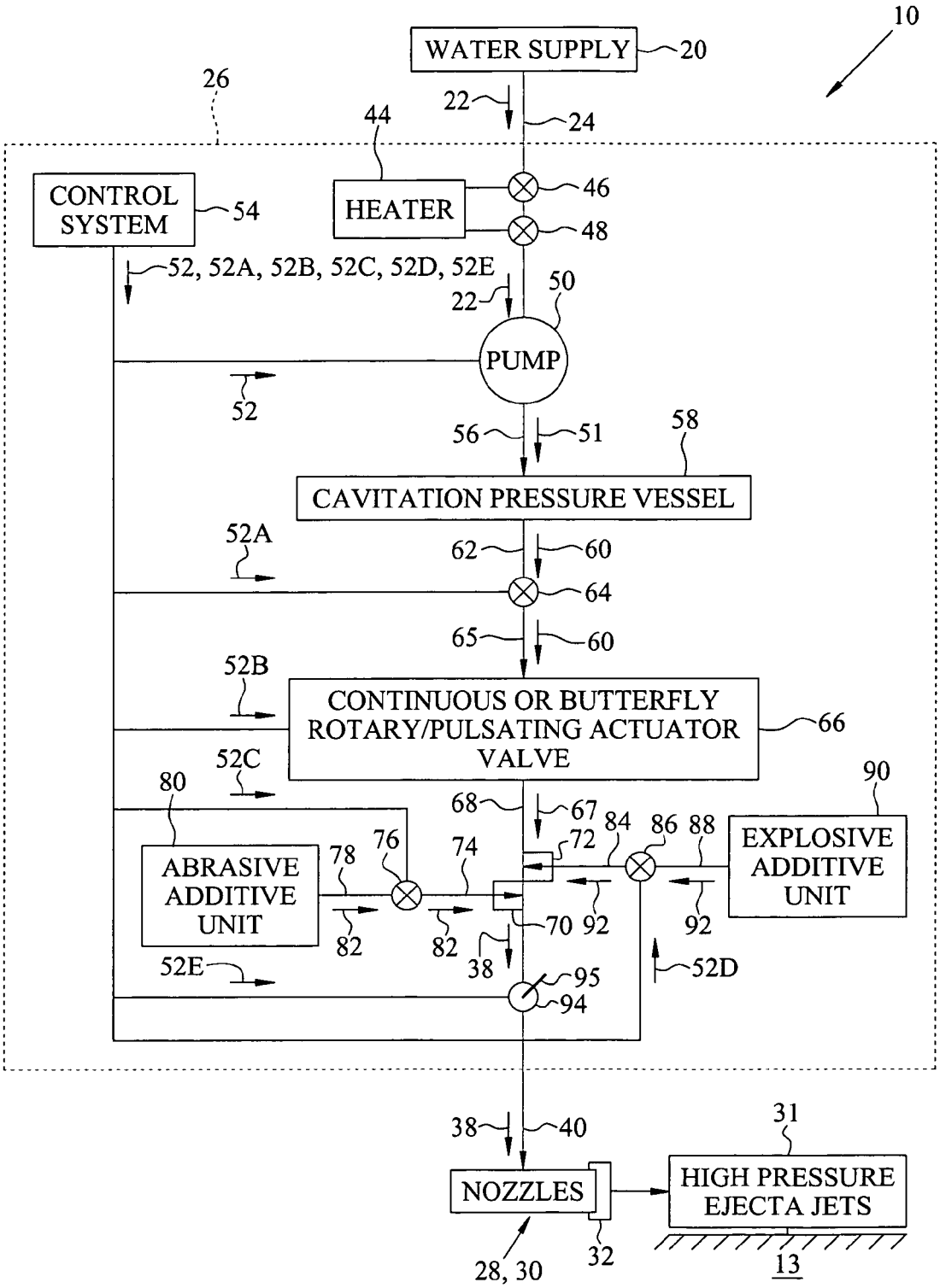
FIG. 3 is a schematic, block diagram of the fluid-pressure power module for supplying highly pressurized fluid for neutralizing mines.

Referring also to FIG. 3, fluid pressure generating module 26 can have a high temperature heater 44 having a pair of valves 46 and 48 connected to feed line 24. Valves 46 and 48 normally give a straight-through interconnection of water/fluid 22 to the rest of fluid pressure generating module 26, but by appropriately switching valves 46 and 48 water 22 can be fed to and from heater 44 and then onto the rest of module 26. Feeding water 22 to and from heater 44 provides the option of raising the temperature of water 22 up to and above boiling temperatures. Heated water 22 might be wanted for some clearing operations since heated water could increase the penetration or cavitation effects of fluid jets 31 from nozzles 30.

Heated or unheated water 22 is drawn into fluid pressure generating module 26 from water supply tank 20 by a pump 50. Control signals shown as arrow 52 from a control system 54 are generated by an operator in support vehicle 16 or by a suitably programmed and initiated computer in control system 54. Control signals 52 are coupled to pump 50 to actuate it to draw in water 22 and couple it as water (shown as arrow 51) under high pressure to a high pressure feed line 56 that is connected to a cavitation pressure vessel 58.

Pump 50 draws in water 22 from tank 20 at atmospheric pressure and creates highly pressurized water 51 at pressure levels approaching, for example, 4,000 bars. Pump 50 can be any one of several commercially available multi-stage models available in the art that are capable of creating highly pressurized water 51 in this range.

Pressurized water 51 in cavitation pressure vessel 58 is accumulated to reach increased pressure levels in sufficient volumes for mine clearing or neutralization operations. The pressure of pressurized water 51 will be raised further in pressure vessel 58 to create outputted water (shown by arrow 60 in high pressure line 62) at higher levels of pressurization, somewhere in the range between 13.7 Mpa and 68.5 Mpa. Highly pressurized water 60 is raised to this pressure range via vessel 58 in order to promulgate the formation of air bubbles in the fluid itself. Vessel 58 has a robustly built structure containing a chamber that meets the ASME pressure vessel code that several manufactures are capable of producing. Exemplary manufacturers of systems and components, including suitable pumps, pressure vessels, etc. that can be used for raising the pressure of fluids, stabilizing impulses from a pump, storing pressurized fluids, and providing sufficient volumes of pressurized fluid for neutralizing mines as called for herein, include but are not limited to: Pressure Products Industries Inc., Warmister, Pa. 18974; NLB corp., 29830 Beck Road Wixom, Mich.; and Sugino Machine Limited of Japan.

High pressurized water 60 is fed through high pressure line 62 to a first valve 64 that can be actuated by suitable control signals 52A from control system 54 to pass high pressurized water 60 through a high pressure feed line 65 to a continuous or butterfly rotary/pulsating actuator valve 66 for selectively modifying flow properties of the high pressurized water 60. Actuator valve 66 can incorporate an on/off flow device, which can be either an on/off via reciprocating or shutter-like device that opens and closes rapidly at selectively variable rates to create a flow (shown by arrow 67) of highly pressurized water to a high pressure feed line 68. Actuator valve 66 can modify the flow characteristics of high pressurized water flow 67 to be continuous or pulsating at selectively different frequencies, pressures, and flow rates when control system 54 feeds suitable control signals (shown by the arrow 52B) to actuator valve 66. Optionally, when a pulsating flow is not needed, such as when a continuous flow is needed for some jetting away of some types of softer soil in ground 13 by jetted water 31, control signals 52B would activate actuator valve 66 to remain open so that water flow 67 might pass through as a continuous flow.

High pressure water flow 67 passes through a high pressure feed line 68 capable of containing flow 67, and a pair of one-way check valves 70 and 72 are connected to feed line 68. Check valve 70 is connected to a feed line 74 extending to a second valve, a control valve 76 having a feed line 78 extending to an abrasive additive unit 80. Control valve 76 is selectively actuated by a control signal (shown as arrow 52C) from control system 54 for selectively adding a powdered or liquefied abrasive composition or abrasive particulate slurry (shown as arrow 82) through feed lines 74 and 78 from abrasive additive unit 80 to high pressure water flow 67 in feed line 68. Abrasive composition 82 in water flow 67 can enrich it to enhance the impact/penetration/cutting effects of fluid jets 31 as they are jetted into ground 13. Abrasive additive unit 80 can be pressurized or have an injector mechanism to force passage of predetermined amounts of a variety of different kinds of commercially available abrasive compositions through feed lines 74 and 78, through check valve 70 and into feed line 68 when control valve 76 is actuated by suitable control signals 52C. Preferably, composition 82 is denser than water to further augment the impact/penetration/cutting effects of fluid jets 31.

31.

Check valve 72 is connected to a feed line 84 extending to a control valve 86 having a feed line 88 extending to explosive additive unit 90. Control valve 86 is selectively actuated by a control signal (shown as arrow 52D) from control system 54 for selectively adding a powdered or liquefied explosive composition or explosive particulate slurry (shown as arrow 92) through feed lines 84 and 88 from explosive additive unit 90 to high pressure water flow 67 in feed line 68. Explosive composition 82 in water flow 67 can enrich pulsating water flow 67 to greatly increase the impact/penetration/cutting effects of fluid jets 31 since these explosive compositions are detonated as they are jetted from nozzles 30 into ground 13. Explosive additive unit 90 can be pressurized or have a smooth running injector feed-mechanism to introduce predetermined amounts of different kinds of well known explosive compositions 92 through feed lines 88 and 84, through check valve 72 and into feed line 68 when control valve 86 is actuated by suitable control signals 52D. Typically, composition 92 might be the explosive Pentaerythritol Tetranitrate (PETN). PETN is the preferred composition because it requires very little energy for detonation and the grain size of the explosive material of composition 92 can be engineered to meet safety requirements for mine neutralization system 10 of the invention. Pulsation of the ejecta of jetted fluid of jets 31 via suitable actuation of actuator valve 66 prevents detonation effects of PETN explosive composition 92 from entering any of nozzles 30. Other explosive compositions can also suggest themselves to one skilled in the art to arrive at the most effective and efficient combination for thorough mine clearing or neutralization operations.

An on/off control valve 94 in fluid pressure generating module 26 is located downstream of check valves 70 and 72, and is actuated or controlled by a control signal (shown as arrow 52E) from control module 54 to connect pure or enriched high pressure water flow 67 in high pressure feed line 68 to high pressure feeder line 40. On/off control valve 94 also can have an externally reaching, manually operated lever 95 for cut-off or activation of fluid jets 31 from nozzles 30.

Vessels including cavitation pressure vessel 58 and feed lines 24, 56, 62, 65, 68, 74, 78, 84, 88, and 40 of mine neutralization system 10 have been used for many years to contain fluids at high pressures (greater than 70 MPa) in many industries such as cannon and small arms fabrication, polyethylene processing, materials processing and high pressure water jet cutting. In fact, many high pressure commercial applications routinely use vessels that operate at pressures reaching as high as about 400 MPa. However, some of these vessels, such as those used in polyethylene processing and water jet cutting, are subjected to high cycle fatigue loading. But, some weapons and some metals processing structures work with operating pressures that are as high as and even greater than 700 Mpa. Pressure vessels operating at or below the 700 Mpa range are not usually subjected to high cycle fatigue loading. Valves 64, 66, 76, 86, and 94 also can be selected from a wide variety of commercially available valve structures. For example, appropriate ones of the valves marketed under the product line designation K-Max by Leslie Industries Inc., of Tampa, Fla. may be selected and used for the valve structures called for in mine neutralization system 10. Accordingly, fabrication of high pressure structures for ducting fluids, as called for in the mine neutralization system 10 disclosed herein, can be done as a matter of routine by one having ordinary skill in the art. Mine neutralization system 10 of the invention can utilize different methods of water jet technology for the neutralization of mines 12 that can be referred to as fluid, fluid-solid, or fluid-solid-gas applications. A fluid only application utilizes a continuous water flow technique using continuous high pressure water flow 67 produced through actuator valve 66 of module 26. Continuous water flow 67 is passed through valve 94 as flow 38 and is thrown out or ejected as continuous water flow jets 31 from nozzles 30 at the speed of about 3 to 4 times the speed of sound. In this case the pressure at pump 50 can be nearly as high as 4,000 bars, and system 10 is capable of processing (cutting through) raw materials such as ground 13.

A variation of the fluid-only application utilizes a pulsed water flow technique having pulsating water flow 67 created by pulsating actuator valve 66 to create pulsating water flow 38 and pulsed water-jets 31 from nozzles 30. The pulsed jets 31 fluctuate as compared to the continuous jet-flow from nozzles of the continuous flow technique. This pulsed flow of jets 31 has sufficient dynamic impact momentum on materials such as ground 13 and mines 12 to break them and provide for more efficient usage of water 22 than the continuous flow and, hence, better chances of neutralizing mines 12.

The fluid-solid application or water-jet-and-abrasive-composition technique has portions of abrasive composition 82 injected into continuous water flow 67 to provide a continuous water flow 38 from valve 94 and jets 31 from nozzles 30 that are enriched with abrasive composition 82. This abrasive-fluid mixture of jets 31 will jet away ground and other matter better because the abrasive material increases cutting ability as compared to cutting with high speed pure water alone. This technique utilizes one way valve 76 to inject and mix abrasive materials/compositions 82 with high-pressured water 67, 38 for ejection as jets 31 from nozzles 30. This technique is commonly used to process materials that have high density such as glass, metal, ceramic and so on and can therefore be effective in clearing away dirt, aggregate, debris, etc. and cut apart or otherwise neutralize mines 13.

Another application of water jet technology is the cavitating water technique that calls for the creation of cavitating jets 31 for impacting ground 13 and mines 12. The combination of pump 50 and pressure vessel 58 is appropriately actuated to raise pressures of water flow 38 into the range between 13.7 Mpa and 68.5 Mpa. Pressures in this range create air bubbles in water flow 38 that are formed physically in the fluid to create a working fluid having a higher impact effect on the dirt, aggregate, debris, etc. of ground 13 and mines 12 by jets 31. The switching stresses created by the cavitating air bubbles of fluid jets 31 as they form, expand, and impact create higher levels of compression and tension in the exited water of fluid jets 31 to break the material of ground 13 and mines 12. The water flow 67 created by actuator valve 66 for the purpose of creating cavitation of jetted fluid 31 can be either continuous or pulsating. Adding abrasive 82 creates the fluid-solid-gas application referred to above.

The synergistic advantages of mine neutralization system 10 of the invention in its application of the techniques of water-jet technology are realized when several parameters are combined to achieve increased efficiency in mine clearing operations. Those parameters consist of utilizing: continuous water-jet, abrasive water-jet, pulsed water-jet and/or cavitating water-jet techniques in combination with abrasive additive compounds 82 and/or explosive additive compositions 92. The continuous water flow technique utilizes pump 50 to produce pressures approaching almost 4,000 bars to provide continuous pressurized water flow 38 at a speed of almost 4 times the speed of sound. Adding the cavitating water-jet technique also makes use of vessel 58 to raise pressures to the range between 13.7 Mpa and 68.5 Mpa where air bubbles are physically formed in fluid 38. This causes impacting jets 31 of system 10 to have even higher impact since the cavitating process enhances the material breaking process. Adding abrasive compositions 82 can further enhance effectiveness by increasing the capability to cut through ground 13 and mines 12. Adding explosive composition 92 further increases the effectiveness of mine neutralization system 10 since adding explosive components to the water flow 38 assures that system 10 effectively mitigates mines 12 through forced detonation/burning and fracture of mines 12 to sterilize or make them safe.

Mine neutralization system 10 of the invention can either cut up mines 12 or detonate the mines by augmenting the cutting abilities of water jets 31 that jet-away ground 13 and parts of mines 12. By adding to or enriching the pulsating water flow of water-jets 31 with an explosive composition 92 that will react exothermically under the high pressure of target impact by jets 31, increased neutralization effectiveness at and in ground 13 will result. Since the constituents of system 10 are spaced a safe distance away and above ground 13, system 10 is designed to survive the detonations that it induces. In other words system 10 effectively mitigates mines 12 without being damaged or destroyed in the de-mining/mitigation process.

Insertion of abrasive compositions 82 from abrasive additive unit 80 and explosive compositions 92 from explosive additive unit 90 can be combined with the continuous water-jet, abrasive water-jet pulsed water-jet, or cavitating water-jet created by the techniques described above. The inserted compositions increase efficiency in some tough clearing operations that may be found in stubborn aggregate and/or clay laden soil compositions in ground 13 and/or tough casings for mines 12.

Mine neutralization system 10 of the invention can utilize or fit on different vehicles to provide a means to effectively mitigate the threat to vehicles and personnel from mines scattered on or off roadway 14. Mine neutralization system 10 creates a motorized means for high-speed sweeping of mines 12 that are scattered on or off a full width area of roadway 14 or buried beneath it. Mine neutralization system 10 eliminates bulky and expensive conventional systems that are cumbersome and labor intensive, and provides a much more effective and safe system with reduced maintenance and spare parts requirements. Mine neutralization system 10 provides for the neutralization of mines 12 at variable depths of penetration in ground 13 and is tunable to successfully neutralize mines 12 in different conditions of soil/road/hard pack.

Having the teachings of this invention in mind, modifications and alternate embodiments of mine neutralization system 10 may be adapted without departing from the scope of the invention. Its uncomplicated, compact design that incorporates structures long proven to operate successfully lends itself to numerous modifications to permit its reliable use under the hostile and demanding conditions routinely encountered during combat in the field. Mine neutralization system 10 can be fabricated in different physical arrangements from a wide variety of materials that have sufficient strengths and properties to reliably perform under a multitude of different operational conditions. Mine neutralization system 10 of the invention can be modified within the scope of this inventive concept to provide an effective piece of equipment that can be modularized for storage and adaptation to a support vehicle 16 for neutralizing mines 12 without incurring unwanted casualties and other collateral damage.

The disclosed components, and their arrangements as disclosed herein, all contribute to the novel features of this invention. Mine neutralization system 10 provides a reliable and capable means of neutralizing mines 12 while preventing unwanted casualties and other collateral damage. Therefore, mine neutralization system 10, as specifically described herein is not to be construed as limiting, but rather, is intended to be demonstrative of this inventive concept.

It should be readily understood that many modifications and variations of the present invention are possible within the purview of the claimed invention. It should also be understood that, within the scope of the appended claims, the invention may be practiced otherwise than as specifically described.

We claim:

1. A mine neutralizing system comprising:

means for providing transportation on a roadway;

means on said transportation providing means for supplying fluid;

means on said transportation providing means and coupled to said fluid supplying means for generating high pressure fluid, said high fluid pressure generating means comprising means for pumping said fluid from said fluid supplying means and partially raising the pressure thereof; means connected to said pumping means for further raising the pressure of said fluid to the pressure of said high pressure fluid; and means coupled to receive said high pressure fluid for selectively modifying flow properties thereof, said selectively modifying flow properties means being an actuator valve configured to selectively modify the flow characteristics of said high pressure fluid to be pulsating at selectively different frequencies, pressures, and flow rates;

means on said transportation providing means and coupled to said high fluid pressure generating means for jetting flow of said high pressure fluid therethrough, said jetting means comprising at least one nozzle, said jetted flow of said high pressure fluid being adapted to neutralize mines on and under said roadway, and said jetted flow of said high pressure fluid being adapted to displace ground, exert pressure to detonate said mines, and cut parts of said mines; and means on said transportation providing means and coupled to said jetting means for orientating said jetting means to direct said jetted flow of said high pressure fluid downward and into ground under said roadway said pumping means being a pump and said further pressure raising means being a cavitation pressure vessel, said pump and said cavitation pressure vessels being configured to raise the pressure of said high pressure fluid to cause cavitation in said jetted flow of said high pressure fluid.

2. The system of claim 1 wherein said high fluid pressure generating means further comprises:

means coupled to receive said high pressure fluid from said actuator valve for adding abrasive to said high pressure fluid before it reaches said jetting means.

3. The system of claim 1 wherein said high fluid pressure generating means further comprises:

means coupled to receive said high pressure fluid from said actuator valve for adding explosive material to said high pressure fluid before it reaches said jetting means.

4. The system of claim 2 wherein said high fluid pressure generating means further comprises:

means coupled to receive said high pressure fluid from said actuator valve for adding explosive material to said high pressure fluid before it reaches said jetting means.

5. The system of claim 4 further comprising:

a first valve interposed between said cavitation pressure vessel and said actuator valve, said first valve configured to control the flow of said high pressure fluid;

a second valve connected to said abrasive adding means, said second valve configured to selectively control the addition of said abrasive to said high pressure fluid;

a third valve connected to said explosive adding means, said third valve configured to selectively control the addition of said explosive material to said high pressure fluid;

a fourth valve connected to said jetting means, said fourth valve configured to control the flow of said high pressure fluid to said jetting means; and a control system connected to said first, second, third and fourth valves adapted to provide control signals for actuation thereof.

6. A method of neutralizing mines comprising the steps of:

providing a support vehicle for transit on a roadway;

mounting a source of fluid on said vehicle;

generating high pressure for said fluid on said vehicle, said step of generating including the steps of:

pumping said fluid by a pump to partially raise the pressure thereof;

further raising the pressure of said fluid to the pressure of said high pressure fluid in a pressure vessel; and selectively modifying flow properties of said high pressure fluid in an actuator valve, said step of selectively modifying flow properties including the step of;

pulsating said high pressure fluid at selectively different frequencies, pressures, and flow rates;

jetting flow of said high pressure fluid from said vehicle through nozzles;

moving said vehicle along a roadway;

orientating said jetting flow of high pressure fluid onto and into said roadway;

neutralizing mines lying on and buried under said roadway by contacting said mines with said jetted flow of said high pressure fluid, said step of neutralizing comprising the steps of:

displacing ground by said jetted flow of said high pressure fluid;

exerting pressure to detonate said mines by said jetted flow of said high pressure fluid; and cutting parts of said mines by said jetted flow of said high pressure fluid, said step of pumping and said step of further raising the pressure being adapted to raise the pressure of said high pressure fluid sufficiently to cause cavitation in said jetted flow of said high pressure fluid.

7. A method of neutralizing mines comprising the steps of:

providing a support vehicle for transit on a roadway;

mounting a source of fluid on said vehicle;

generating high pressure for said fluid on said vehicle;

adding explosive material to said high pressure fluid;

jetting flow of said high pressure fluid from said vehicle through nozzles;

moving said vehicle along a roadway; and orientating said jetting flow of high pressure fluid onto and into said roadway.

8. A mine neutralizing system comprising:

a vehicle capable of providing transportation on a roadway;

a source of fluid on said vehicle;

a pump on said vehicle connected to said fluid source and capable of partially raising the pressure of said fluid;

a cavitation pressure vessel on said vehicle coupled to the outlet of said pump to accumulate fluid at high pressure;

an actuator valve coupled to said cavitation pressure vessel configured to selectively modify the flow characteristics of said high pressure fluid to be pulsating at selectively different frequencies, pressures, and flow rates;

at least one nozzle on said vehicle coupled to said actuator valve, said nozzle configured to jet flow of said high pressure fluid therethrough;

a framework on said vehicle connected to said at least one nozzle configured to orient said at least one nozzle to direct said jetted flow of said high pressure fluid downward and into ground under said roadway;

an abrasive additive unit coupled to receive said high pressure fluid from said actuator valve to add abrasive to said high pressure fluid before it reaches said at least one nozzle; and an explosive additive unit coupled to receive said high pressure fluid from said actuator valve to add explosive material to said high pressure fluid before it reaches said at least one nozzle;

wherein said pump and said cavitation pressure vessel are configured to be capable of raising the pressure of said high pressure fluid to cause cavitation in said jetted flow of said high pressure fluid.

9. The system of claim 8 further comprising:

a first valve interposed between said cavitation pressure vessel and said actuator valve, said first valve configured to control the flow of said high pressure fluid;

a second valve connected to said abrasive additive unit, said second valve configured to selectively control the addition of said abrasive to said high pressure fluid;

a third valve connected to said explosive additive unit, said third valve configured to selectively control the addition of said explosive material to said high pressure fluid;

a fourth valve connected to said at least one nozzle, said fourth valve configured to control the flow of said high pressure fluid to said jetting means; and a control system connected to said first, second, third and fourth valves adapted to provide control signals for actuation thereof.

* * * * *